US006651926B1

(12) United States Patent
Alexander, III

(10) Patent No.: US 6,651,926 B1
(45) Date of Patent: Nov. 25, 2003

(54) METALLIC REEL AND METHOD

(76) Inventor: William J. Alexander, III, P.O. Box 848, Mauldin, SC (US) 29662

( * ) Notice: Subject to any disclaimer, the term of this patent is extended or adjusted under 35 U.S.C. 154(b) by 0 days.

(21) Appl. No.: 10/186,786

(22) Filed: Jul. 1, 2002

(51) Int. Cl.[7] ..... B65H 75/20; B65H 75/22

(52) U.S. Cl. ..... 242/604.1; 242/608.4; 242/610.5

(58) Field of Search ..... 242/604, 604.1, 242/608.4, 608.3, 610.5, 118.6, 118.7, 118.1

(56) References Cited

U.S. PATENT DOCUMENTS

| | | | | | |
|---|---|---|---|---|---|
| 877,397 | A | * | 1/1908 | Bvinley | 242/608.4 |
| 1,511,285 | A | * | 10/1924 | Lachman | 242/604.1 |
| 1,885,734 | A | * | 11/1932 | Lachman et al. | 242/608.4 |
| 1,915,825 | A | * | 6/1933 | Hescock | 242/608.4 |
| 1,924,541 | A | * | 8/1933 | Clemmons | 242/608.4 |
| 2,097,778 | A | * | 11/1937 | Schaub | 242/604 |
| 2,741,442 | A | * | 4/1956 | Aupperle | 242/118.6 |
| 4,345,724 | A | * | 8/1982 | Lindell | 242/604.1 |
| 5,934,606 | A | * | 8/1999 | Guild | 242/608.4 |

FOREIGN PATENT DOCUMENTS

| | | | | |
|---|---|---|---|---|
| EP | 0 491 400 A1 | * | 6/1992 | 242/608.4 |

* cited by examiner

*Primary Examiner*—John M. Jillions

(57) ABSTRACT

A metallic reel construction wherein spokes (C) are welded at spaced locations directly to end plates (B) and to rims (A). The end plates receive the staves (D) that are directly and rigidly affixed thereto in spaced relation to provide a relatively small hub providing rigidity and yet being capable of receiving a large amount of flexible material. Threaded members (E) rigidly connect the rigid rim and hub end plate assemblies adjacent to the ends of the staves for speedy assembly permitting shipment while disassembled.

17 Claims, 4 Drawing Sheets

METALLIC REEL AND METHOD

This invention relates to rigid metal reels that are capable of speedy assembly for winding and for distributing flexible material. The reels remain disassembled for shipping and storage in a minimum of space preparatory to assembly for winding, storing, and dispensing flexible material.

BACKGROUND OF THE INVENTION

The prior art includes metallic reels utilizing centrally disposed metallic end plates to which spokes are welded on one end while the other end is welded to metallic rims. A number of radially spaced staves are loosely connected between opposed aligned spokes. The connection between the staves and the spokes is accomplished through the use of metal stirrups welded to the spokes providing a slot for receiving an end of each of the respective staves. These reels may be easily assembled but because of the loose fitting connections between the staves and the spokes, the assembled reels shimmy and do not provide stable supports for the flexible materials wound thereon. Because the staves are located remote from the centers of the rims, a relatively large drum is provided for receiving the flexible material for storage. This diminishes the amount of material that may be stored on the reel.

The prior art is further illustrated by U.S. Pat. No. 4,345,724 that discloses a structure similar to that described above. The reel of the patent utilizes a small central hub rather than an end plate so that even less support is provided for the spokes. The staves are spaced outwardly from the hub and attached loosely to the spokes by means of a receptacle and a cotter pin for maintaining the staves within the receptacles. Metallic reels constructed in accordance with the patent evidently provide even more flimsy constructions than the prior art discussed above.

More and more, reels are required to satisfy the increasing need for laying cables including fiber optic cables of the type utilizing a woven sheath for covering the cable fibers. Metallic reels constructed in accordance with the invention are especially useful in storing and dispensing woven sheaths for fiber optic cables of various closed configurations for retaining the fibers. The metallic reels are also especially useful for shipping flexible material of any sort including woven paper and plastic sheet material. It is especially important that such reels be rigid and stable in order to provide effective support for the flexible material and that the reel construction be capable of speedy assembly thus providing ease of storage and shipping to reel users when used.

It is important that the reels be light in weight and yet possess strength and rigidity to provide effective support when material is wound thereon so as to replace the heavy reels currently in the market place that are constructed of wood and plastic in a variety of configurations.

SUMMARY OF THE INVENTION

Accordingly, it is an object of the invention to provide light weight metallic reels of substantial rigidity capable of speedy assembly and disassembly.

Another important object of the invention is to provide metallic reels avoiding the use of disposable wood and plastic reels.

Another important object of the invention is to provide a metallic reel that is quickly assembled and providing substantial rigidity with increased capacity for storing, shipping, and distributing flexible material therefrom.

Still another important object of the invention is to provide a rigid metallic reel wherein staves are rigidly connected directly upon a centrally disposed metallic end plate preferably of a hexagonal configuration, and wherein the spokes are also connected by spaced plug welds to the end plates. The end plates provide a means for readily spacing the staves wherein planer surfaces are provided on each side of vertical slots at the corners of the end plates on either side of respective spokes. The removable connecting members are preferably threaded body bolts of the type that include washers retained closely adjacent to the heads of the bolts to facilitate placement of the end of the staves on the inside of the end plates wherein tabs affixed at an end of the staves opposite the flat surfaces of the washers assure a sturdy and rigid connection. Threaded shanks on the bolts pass through the slots into the tabs. By shipping the reels while disassembled, considerable space is saved on the truck.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a metal reel for winding single and multi-layer material thereon for storage and delivery having a pair of spaced metal rims A for confining the material wound on the reel therebetween. A metallic hub end plate B is centrally located and aligned within each respective rim. A plurality of circumferentially spaced tubular metallic spokes are welded on one end to the rims and on the other end to respective hub end plates providing a rigid rim and hub end plate assembly. A plurality of tubular metallic staves D are rigidly connected on respective ends to a metallic hub end plate forming a hub assembly. Threaded members E connect the rigid rim and hub end plate assemblies adjacent to the ends of the staves. Thus, the rigid rim and hub end plate assemblies and the hub assemblies are rigidly connected by the threaded members for speedy assembly permitting shipment while disassembled, and quick assembly for use.

Figure 1:
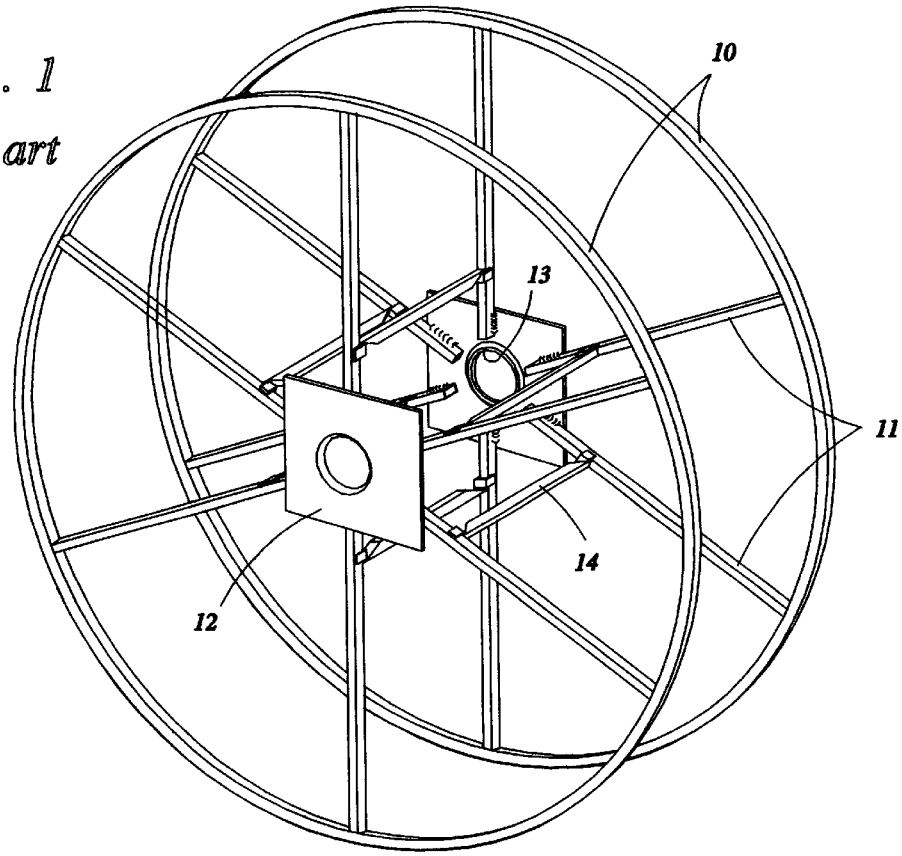
Fig. 1 prior art
FIG. 1 is a perspective view illustrating a metallic reel constructed in accordance with the prior art wherein small end plates receive spokes welded thereto on one end and to the rim on the opposite end. Staves are loosely secured between opposed spokes to provide a construction which may be readily assembled for winding and shipment.
Figure 2:
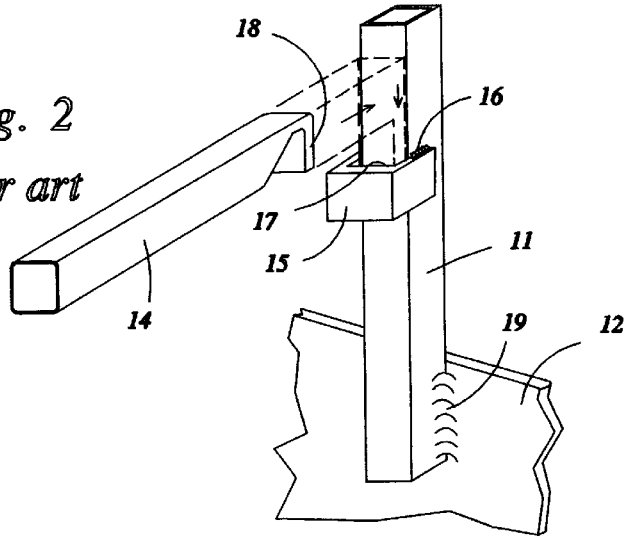
Fig. 2 prior art
FIG. 2 is a perspective view illustrating an end plate to which a spoke is welded. The spokes are provided with stirrups for receiving down turned end of the respective staves. Because the down turned end of the staves are formed from the tubular metallic shape, a loose fit must be provided to adjust for tolerances so that the staves may be inserted into the stirrups.

FIGS. 1 and 2 illustrate a metal reel constructed in accordance with the prior art wherein a pair of opposed metallic aligned rims are illustrated at 10. The rims 10 are supported by circumferentially spaced spokes 11 that are welded to relatively small end plates 12 on one end and to the rims on the other end.

The end plates each have inwardly facing flanges 13 that serve as hubs for chucking the reel for winding. A number of spaced staves 14 are loosely secured on each end between the spokes 11.

FIG. 2 illustrates the mode of attachment wherein the spokes 11 are provided with metallic stirrups 15 that are welded at each of the free ends as at 16 providing a slot 17 for insertion of downturned ends 18 of the respective staves 14. The spokes 11 are illustrated in FIG. 2 as being welded at a single location 19 to an end plate 12.

Figure 3:
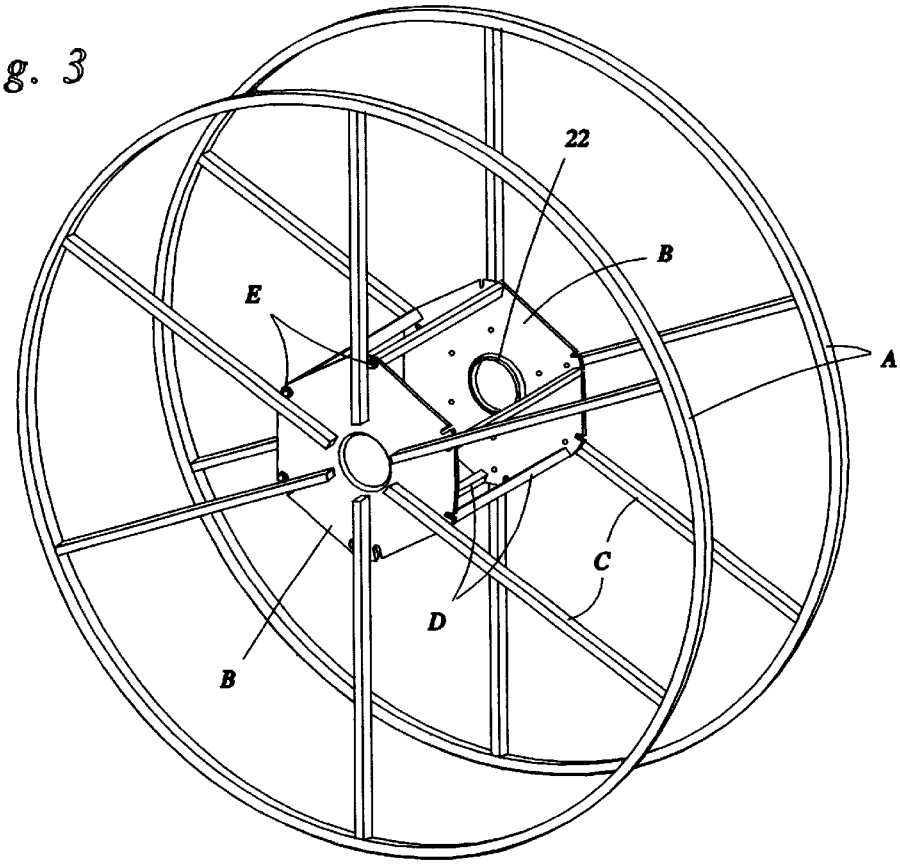
FIG. 3 is a perspective view of a metallic reel constructed in accordance with the invention wherein the spokes are welded at spaced locations directly to the end plates and to the rims on the other end. The end plates receive the staves that are directly and rigidly affixed thereto and in spaced relation to provide a relatively small hub providing rigidity and yet being capable of receiving a large amount of flexible material.
Figure 4:
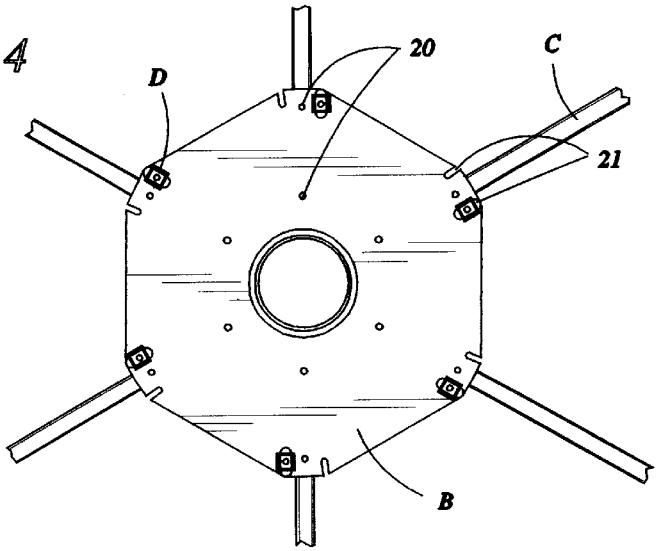
FIG. 4 is a transverse sectional view illustrating the end plates from the inside toward the radially spaced welds for the spokes and securement for staves directly to the end plates rigidly thereupon.
Figure 5:
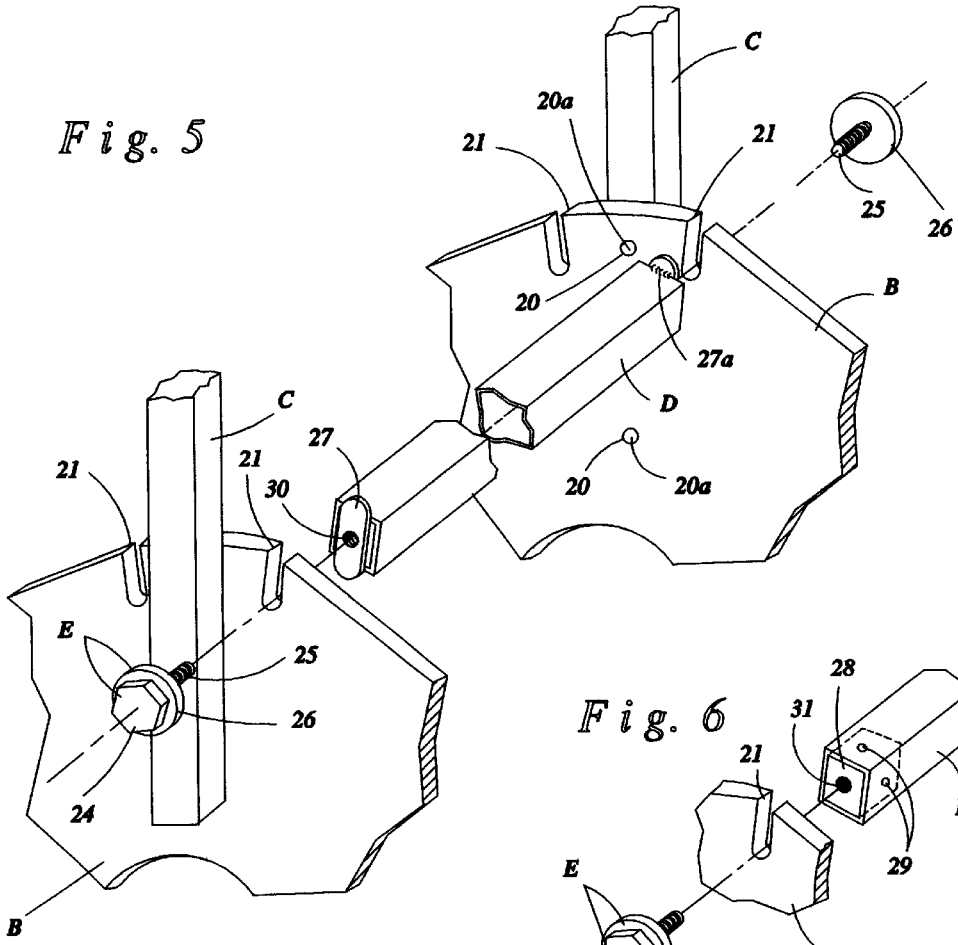
FIG. 5 is an enlarged perspective view illustrating a preferred mode of attachment at the outside of the end plates by a threaded connection to flat surfaces provided upon the respective ends of the stave.
Figure 6:
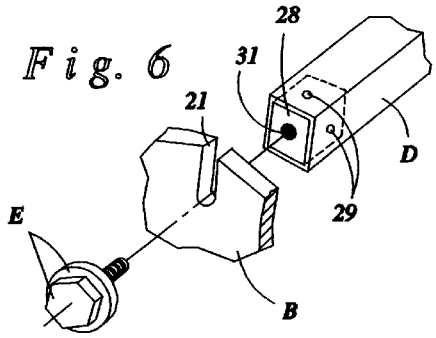
FIG. 6 is a perspective view similar to FIG. 5 illustrating a modified form of the invention wherein the provision of flat surfaces at the end of the staves are facilitated by the insertion of metal plugs for reception by the inside surface of an end plate for receiving a threadable connecting member affording a complimentary flat surface for reception upon the outside of the respective end plates.
Figure 7:
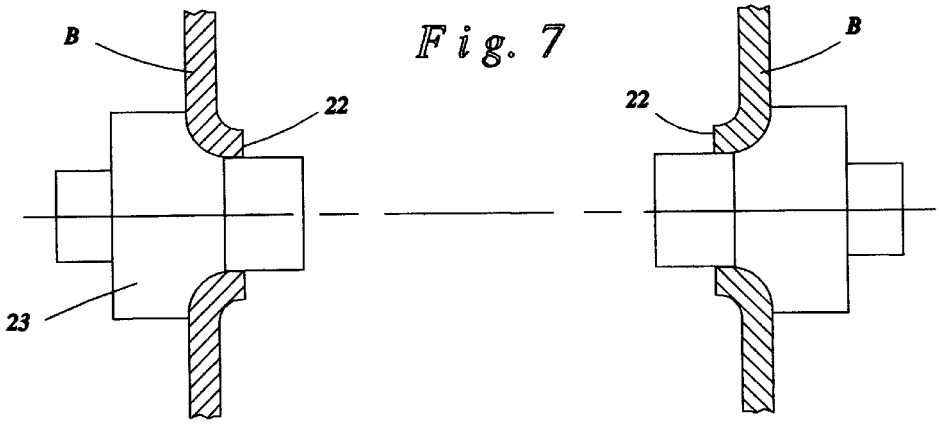
FIG. 7 is a longitudinal sectional elevation view through a central portion of an end plate for receiving a suitable chucking member mounting the reels for winding.

FIG. 3 illustrates a metallic reel constructed in accordance with the invention wherein the opposed rims A are provided with end plates B that are centrally located and welded at two spaced locations to the end plates. The welds are located in radially spaced holes illustrated at 20 in FIG. 5 by plug welds 20*a*. It will be observed that in FIG. 4, the end plates are preferably hexagonal with the spokes C being welded at the corners with vertical slots 21 being provided on each side to receive a threaded shank carried by the connecting members E as best illustrated in FIGS. 5 and 6. As illustrated in FIG. 7, the end plates have inwardly turned flanges illustrated at 22 that serve as hubs for chucking the reels for winding. Mandrels 23 serve as chucking members as illustrated in FIG. 7.

Figure 8:
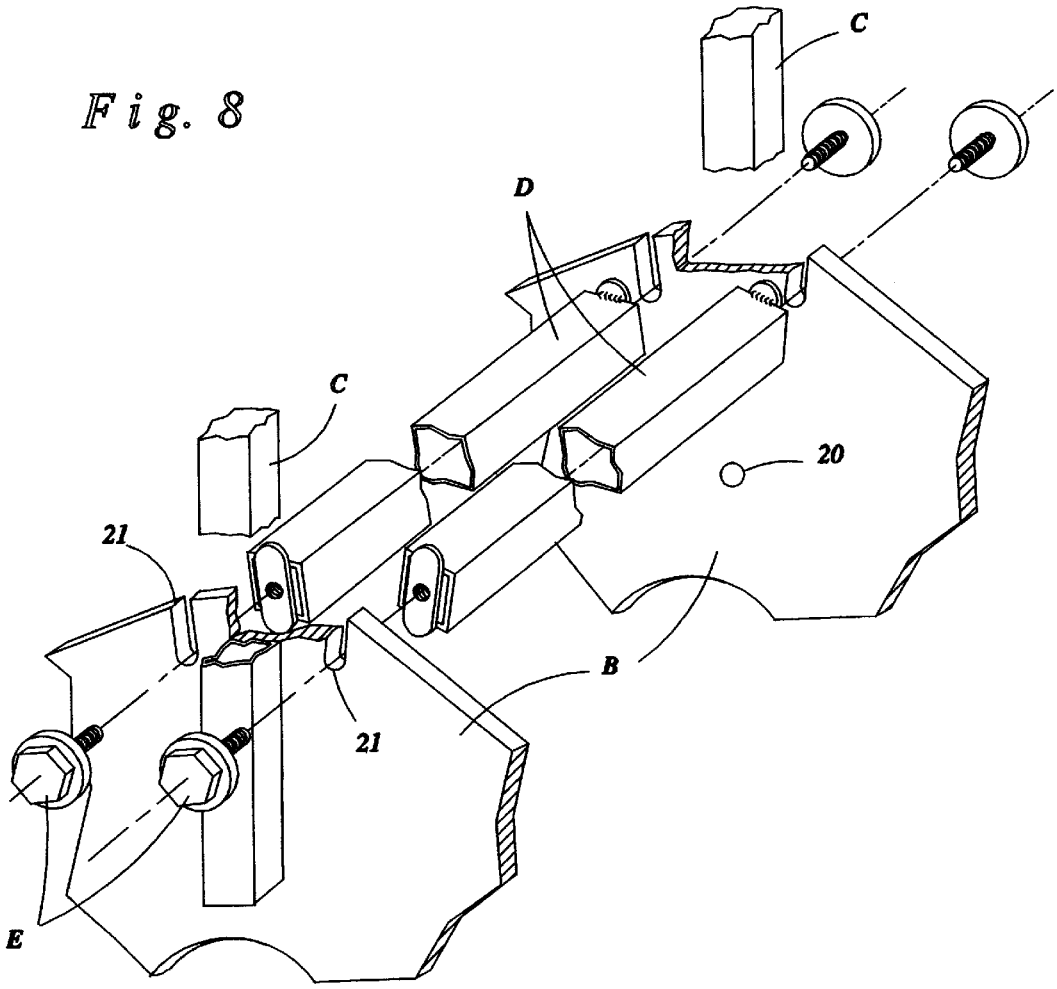
FIG. 8 is a perspective view of a central hub of a reel construction in accordance with a modified form of the invention wherein a stave is received between slots on either side of the respective spokes for providing a hub of increased surface area to thereby accommodate the flexible material thereon.

The threaded connecting members are illustrated in FIGS. 5, 6, and 8 as including bolt heads 24 with partially threaded shanks at 25. A portion of the shanks immediately adjacent the inside of the bolt heads 24 are not threaded (not shown) so as to receive washers 26. Since the threaded portions 25 are of larger diameter than the unthreaded shank portions (not shown) adjacent the inside of the bolt head 24 the washer fitting thereon cannot be removed thus assuring during assembly that the washer is always carried adjacent the outside of the open upstanding slot 21. Flat tabs 27 are welded as at 27*a* across each end of the respective staves so as to be received outside and in alignment with open slots 21. Since the flat or planer surfaces of the washers and the tabs are located on either side of the end plates B, a rigid connection is formed between the staves and the end plates. The tabs are provided with threaded holes 30. By using an air wrench, single applications thereof are all that is necessary to secure the bolts.

A modified form of the invention is illustrated in FIG. 6 wherein square plugs 28 are inserted in respective open ends of the staves B and are fixed therein by deforming the tubular stirrups D on each of their four sides as at 29 or by welding (not shown). The plugs are provided with threaded holes 31 for receiving the threaded bolts.

FIG. 8 illustrates a modified form of the invention wherein a pair of closely spaced staves are secured between respective adjacent vertical slots 21 in the end plates B. The more closely spaced staves provides a stronger, more adaptable hub surface for receiving material wound thereon.

While a preferred embodiment of the invention has been described using specific terms for the several structural components, such description is for illustrative purposes only, and it is to be understood that changes and variations may be made without departing from the spirit or scope of the following claims.

What is claimed is:

1. A metal reel that is easily assembled for use in winding single and multi-layer material thereon for shipping, storage, and delivery comprising:

a pair of spaced metal rims for confining the material wound on the reel therebetween;

a metallic hub end plate centrally located and aligned within each respective rim;

a plurality of spaced metallic spokes rigidly connected on one end to the rims and on the other end to respective hub end plates providing rigid rim and hub end plate assemblies;

a plurality of metallic staves rigidly connected on respective ends by a rigid threaded member to a metallic hub end plate forming a hub assembly; and whereby the rigid rim and hub end plate assemblies and hub assemblies are rigidly connected by the threaded members for speedy assembly.

2. The metal reel set forth in claim 1 including a pair of opposed flat surfaces formed at an end of the staves and the threaded members between which the metallic hub end plates are rigidly fastened.

3. The metal reel set forth in claim 1 wherein the end plates are hexagonal and at each corner of which a spoke is welded by radially spaced plug welds, and aligned slots adjacent the corners for receiving the threaded members forming rigid connections providing stability to the reel.

4. The metal reel set forth in claim 2 wherein a tab having a flat surface is welded across each flat end of the staves.

5. The metal reel set forth in claim 2 wherein an internally threaded square nut is inserted into an end of the staves providing a flat surface.

6. The metal reel set forth in claim 2 including aligned slots on each side of the spokes for positioning a greater number of staves further strengthening the reel and providing additional surfaces for receiving the flexible material.

7. The metal reel set forth in claim 1 wherein a central opening defined by internal flanges are provided in the end plates.

8. A metal reel that is easily assembled for winding single and multi-layer material thereon for shipping storage and delivery comprising:

a pair of spaced metal rims for confining the material therebetween;

a metallic hub end plate centrally located and aligned within each respective rim;

a plurality of spaced end tubular metallic spokes rigidly connected on one end to the rims and on the other end to respective hub end plates providing rigid rim and hub end plate assemblies;

a plurality of tubular metallic staves rigidly connected on respective ends by a removable connecting member to a metallic hub end plate forming a hub assembly; and whereby the rigid rim and hub end plate assembly and hub assembly are rigidly connected by the connecting members for speedy assembly wherein the metallic hub end plates serve the dual purpose of fixedly joining the spokes and the staves.

9. The metal reel set forth in claim 8 wherein the spokes are attached to the end plate by spaced plug welds.

10. The metal reel set forth in claim 9 wherein the staves are received in spaced aligned slots in the end plates, the end plates being rigidly fastened between flat connected surfaces.

11. The metal reel set forth in claim 10 wherein the end plates are hexagonal and wherein the spokes are located on each corner of the plate.

12. A method of assembling a metal reel for winding flexible material thereon for storage and delivery comprising the steps of:

spacing and aligning metal rims for confining the material wound on the reel therebetween;

locating a metallic hub end plate centrally and in aligned relation within respective metallic rims;

welding a plurality of radially spaced tubular metallic spokes on one end to the rims and on the other end to respective hub end plates providing rigid rim and hub end plate assemblies;

connecting a plurality of tubular metallic staves rigidly on respective ends to a metallic hub end plate forming a hub assembly for receiving the flexible material; and connecting the metallic hub end plates on the other end of the staves by a threaded connection;

whereby the rigid rim and hub end plate assemblies and hub assemblies are rigidly connected for speedy assembly for receiving the flexible materials.

13. The method of assembling a metal reel set forth in claim 12 including the step of storing and shipping disassembled reels prior to the step of connecting a plurality of tubular metallic staves rigidly on respective ends to a metallic hub end plate forming a hub assembly for receiving the flexible material.

14. The method of assembling a metal reel set forth in claim 12 including the step of making the metallic hub plates in hexagonal shapes so that welding of the spokes thereto may be facilitated by locating the plug welds at the corners of the hexagonal shapes.

15. The method of assembling a metal reel set forth in claim 12 including the step of making the metallic hub plate in a hexagonal shape so that fixing of the staves thereto may be facilitated by locating spaced slots therefor.

16. The method of assembling a metal reel as set forth in claim 14 and including the step set of providing opposed flat surfaces between which the hub plate is interposed preparatory to fastening.

17. The method of assembling a metal reel as set forth in claim 16 including the step of fastening the rigid rim and back end plate assemblies and the staves by tightening threaded connecting members.

* * * * *